United States Patent [19]

Ruseff

[11] 4,212,596

[45] Jul. 15, 1980

[54] PRESSURIZED FLUID SUPPLY SYSTEM

[75] Inventor: Walter Z. Ruseff, New Lenox, Ill.

[73] Assignee: Caterpillar Tractor Co., Peoria, Ill.

[21] Appl. No.: 880,822

[22] Filed: Feb. 23, 1978

[51] Int. Cl.[2] ..... F04B 49/00

[52] U.S. Cl. ..... 417/216; 60/430; 60/486; 417/222

[58] Field of Search ..... 417/216, 222, 213; 60/428, 430, 486

[56] References Cited

U.S. PATENT DOCUMENTS

| | | | |
|---|---|---|---|
| 3,723,026 | 3/1973 | Soyland et al. | 417/286 |
| 3,738,779 | 6/1973 | Hein et al. | 417/213 |
| 3,767,327 | 10/1973 | Wagenseil | 417/216 |
| 3,774,505 | 11/1973 | McLeod | 91/506 |
| 3,784,327 | 1/1974 | Lonnemo | 417/222 |
| 3,788,773 | 1/1974 | van der Kolk | 417/213 |
| 3,862,588 | 1/1975 | Bahrle et al. | 91/486 |
| 3,891,354 | 6/1975 | Bosch | 417/216 |
| 3,897,174 | 7/1975 | Capelle et al. | 417/216 |
| 3,941,514 | 3/1976 | Louis et al. | 417/216 |
| 3,968,650 | 7/1976 | Bacquie et al. | 60/428 |
| 3,999,892 | 12/1976 | Hein | 417/216 |
| 4,032,260 | 6/1977 | Bosch | 417/216 |

FOREIGN PATENT DOCUMENTS

| | | |
|---|---|---|
| 1528476 | 8/1969 | Fed. Rep. of Germany . |
| 1922269 | 11/1970 | Fed. Rep. of Germany . |
| 1128657 | 10/1968 | United Kingdom . |
| 1212625 | 11/1970 | United Kingdom . |

*Primary Examiner*—Carlton R. Croyle
*Assistant Examiner*—Edward Look
*Attorney, Agent, or Firm*—Phillips, Moore, Weissenberger, Lempio & Majestic

[57] ABSTRACT

Variable displacement pumps are each provided with internal biasing means which adjusts displacement in response to spring forces, discharge pressures and net swivel torque forces in order to limit output pressure and to avoid overtaxing the power output capabilities of the motor which drives the pumps. In a system where a plurality of such pumps each supply a separate fluid-operated device but are driven by a single motor, the internal displacement control means of each pump may be arranged to be responsive in part to the discharge pressure of each other pump. The pumps may operate at different power output levels and if one experiences a relatively heavy load, the displacements of the others also reduce if necessary to avoid exceeding the power limitations of the drive motor from a total system overload.

12 Claims, 4 Drawing Figures

38
39
37
34
41
76
77
74
64
70
72
51
49
54
13
36
II
63
68
73
71
II
31
18
32
69
62
56
52
66
53
19
16
19
59
61
28
30
48
57
47
58
26
27
67
11
21
22
23
42
44
24
29
14
43
12
46
M
17

16
TDC
22A
31
32
33
BDC 70B
39B
28B
77B
74B
76B
41B
34B
14B
11B
17A
M
70A
74A
11A
48A
39A
77A
76A
28A
41A
34A
14A
47A

PRESSURIZED FLUID SUPPLY SYSTEM

BACKGROUND OF THE INVENTION

This invention relates to pressurized fluid supply systems which use a plurality of variable displacement pumps to provide operating fluid to a plurality of fluid-operated devices.

Fluid-operated devices, such as hydraulic actuators or cylinders for example, are usually operated with pressurized fluid supplied through a control valve from a pump driven by a motor. In most systems of this kind means must be provided to limit the output pressure of the pump both to avoid overtaxing the power output capabilities of the drive motor and to avoid excess leakage, hose or seal rupture and other adverse effects of an overpressure.

If the pump is of the fixed positive displacement type, a relief valve is connected between the pump output and the fluid reservoir to limit output pressure and to avoid lugging down and possible stalling of the drive motor. At such times as high-pressure fluid is being released back to the reservoir through the relief valve, a power wastage is occurring in that the motor must do work simply to force fluid through the relief valve back to the reservoir.

In order to reduce the power wastage which occurs when fluid is returned to tank through a relief valve, many pressurized-fluid supply systems use variable displacement pumps. Vairable displacement pumps have a control element which may be adjusted to change the amount of fluid translated through the pump during each pump shaft revolution between a maximum value and a minimum value. Feedback or servo mechanisms, commonly known as pressure compensators, are provided which sense output pressure and which function to increase displacement when output pressures are low and to reduce displacement, down to zero if necessary, when output pressures rise above a predetermined maximum value. System overpressures and possible stalling of the drive motor are avoided without relying on a continual pumping of a sizable fluid flow from the tank back to the tank through a relief valve.

As heretofore, constructed, pressure compensator arrangements have resulted in considerable complication of the structure of the system with adverse effects on bulk, weight and costs.

Certain pumps of this general type that have asymmetrical porting configurations are subject to an effect known as swivel torque force which tends to shift the pump towards the zero displacement position with a force which increases in magnitude as discharge pressure rises. Part of the complication and size of pressure compensator means in prior pumps of this type has resulted from arrangements designed to counteract this effect. It has not heretofore been recognized that swivel torque force may be advantageously utilized to aid in the pressure-limiting function.

Further problems are present in prior systems where a single drive motor operates a plurality of variable displacement pumps each of which supplies fluid to a separate driven device through a separate control valve. This is a common situation in various earthworking vehicles, for example, in which a single motor may drive several different pumps each associated with different fluid cylinders which operate different implements on the vehicle. A conventional pressure compensator at each pump avoids overpressures in the output of that particular pump and avoids overtaxing the drive motor insofar as the output power from that particular pump is concerned, but still further system complication has been needed to assure that the totalized loads of all of the pumps at any given time do not collectively overtax the driving motor.

To avoid overloading of the drive motor, the common practice has been to provide a summing valve receiving a pressure signal from the output of each of the pumps in the system and which acts to synchronously reduce the displacement of all of the pumps if the totalized output pressures exceed a predetermined maximum value. Aside from the structural complication involved, the action of a summing valve interferes with most efficient use of the system. In particular, the conventional arrangements cause the displacements of all pumps in the system to be decreased synchronously as the totalized output pressure from all pumps rises. All of the pumps in such a system are constrained to operate at the same power output level although the power requirements of the several fluid-operated devices associated with the several pumps may vary considerably.

If a particular pump experiences a relatively heavy loading, it would be preferable in many systems that it be able to operate at a higher power output level than the other pumps while the displacements of the other pumps are reduced, if necessary, to avoid overloading of the drive motor.

SUMMARY OF THE INVENTION

The present invention is directed to overcoming one or more of the problems as set forth above.

According to the present invention, a plurality of pumps each having an internal control element which may be shifted to vary displacement are also provided with internal biasing means responsive to spring forces and discharge fluid pressure forces including means which urges the control element towards the maximum displacement position and means which exerts a counterforce urging the control element towards the minimum displacement position. The displacement-increasing forces predominate when pump discharge pressure is low. As discharge pressure rises, the displacement-decreasing forces include a rising net swivel torque force and eventually act to limit power output and output pressure at the pump by decreasing displacement as necessary for that purpose.

The pump construction enables realization of highly useful new results when embodied in a multiple-pump system of the form in which a plurality of such pumps each supply fluid to separate devices through separate control valves but are driven by a single motor. In particular, the displacement-decreasing biasing means of one or more of the pumps may be arranged to be responsive in part to the discharge pressures of one or more of the other pumps in the system. This provides a specialized form of summing action in which excessive loading of the driving motor is avoided by decreasing pump displacements as necessary for this purpose but without requiring all pumps to operate at the same degree of reduced power output. The displacements of all of the pumps in the system are not necessarily decreased synchronously in reponse to a system overload condition. Power output at the particular one of the pumps which is experiencing the overload may be maintained while the displacements of one or more of the other pumps are reduced to avoid the total system overload.

DESCRIPTION OF PREFERRED EMBODIMENTS

Figure 1:
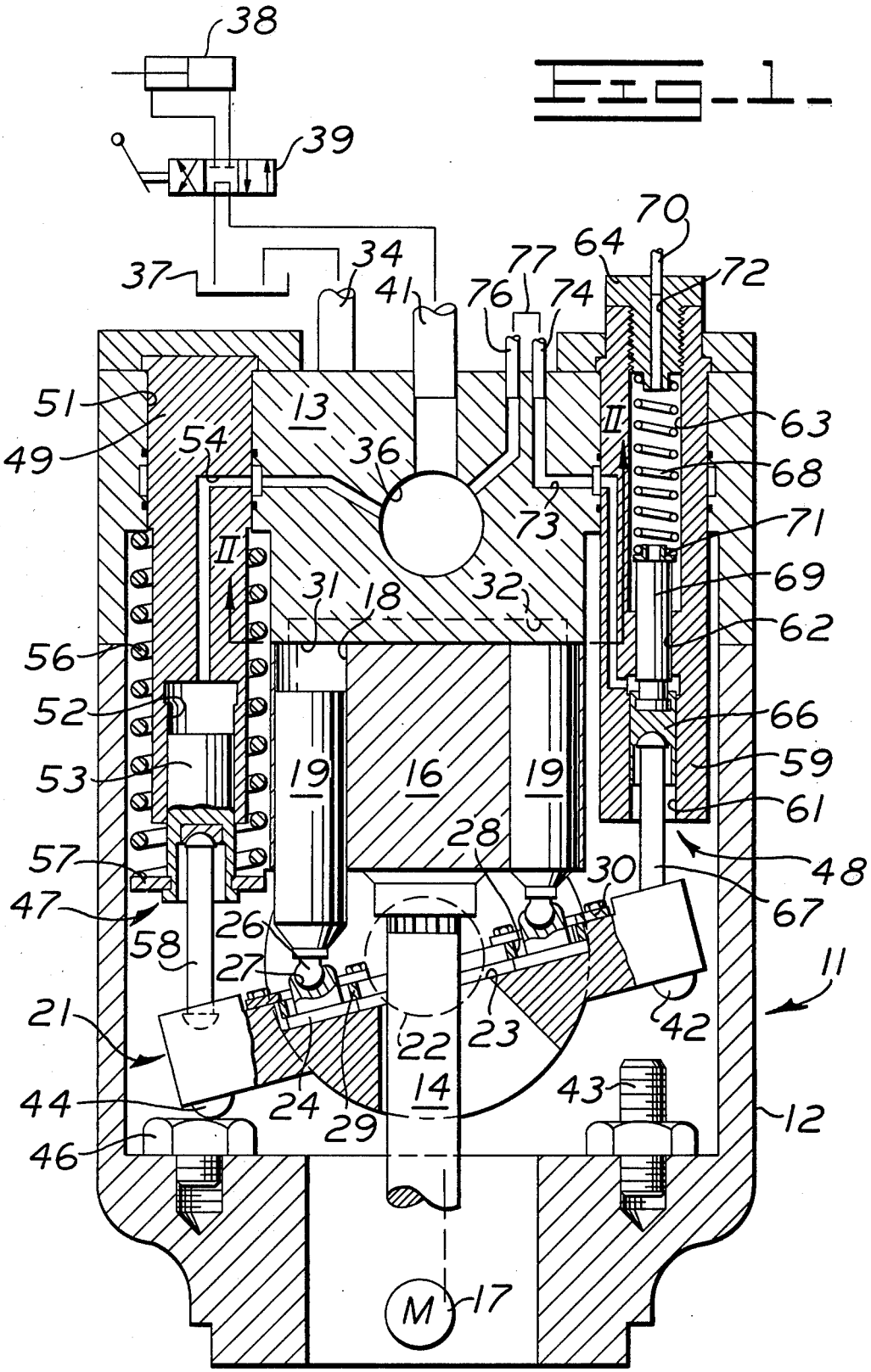
FIG. 1 is an axial section view of a variable displacement pump.

Referring initially to FIG. 1 of the drawing, a variable displacement pump 11 is depicted which is basically of the axial piston form. In certain specific respects the invention is uniquely suited to axial piston pumps and will therefore be described in that context but it should be understood that broad aspects of the invention are also applicable to other forms of variable displacement pump such as radial piston pumps for example.

Basic components of an axial piston pump 11 may include a hollow cylindrical housing 12 and a porting head 13 forming a closure at one end of the housing. A rotary drive shaft 14 extends into the other end of the housing 12 along the rotary axis of the pump and is coupled to a rotatable cylindrical barrel member 16 disposed coaxially within the housing for rotation with the drive shaft. Shaft 14 is turned by the drive motor 17 which operates the pump.

Barrel 16 is provided with a plurality of cylinder passages 18 which extend parallel to the rotary axis of the barrel and which are equidistantly spaced from the rotary axis of the pump and equiangularly spaced from each other. One of a like plurality of pistons 19 extends into each such cylinder passage 18 for reciprocating movement in the associated cylinder passage to effect the pumping action.

To reciprocate the pistons 19 as the drive shaft 14 is turned, an annular swashplate 21 is disposed within housing 12 at the opposite end of barrel 16 from porting head 13. Swashplate 21, which functions as a displacement control element as will be hereinafter described in more detail, is supported in housing 12 through a trunnion 22 which has a rotary axis normal to that of the drive shaft 14 enabling the swashplate to be controllably tilted relative to the rotational axis of the drive shaft and barrel. Swashplate 21 has a flat circular cam surface 23 facing barrel 16 against which a series of slipper pad elements 24 are disposed.

An end of each of the pistons 19 extends from barrel 16 towards swashplate 21 and has a ball element 26 which is received in a conforming cavity 27 on an associated one of the slipper pads 24. As the barrel 16 is turned by motor 17 through drive shaft 14 the slipper pads 24 each move in a circular path on cam surface 23 of the swashplate. If the swashplate is canted relative to the rotary axis of the pump, this slipper pad motion forces a reciprocating motion of each of the pistons 19 within barrel 16. To assure that the slipper pads 24 remain in contact with cam surface 23 at all times during this circular motion, each pad extends through one of a series of openings 28 in a hold-down member 29 and has a flanged base of larger diameter than the openings. Retainer means 30 secured to the swashplate overlaps the rim of the hold-down member allowing it to rotate with the slipper pads.

Figures 2, 3:
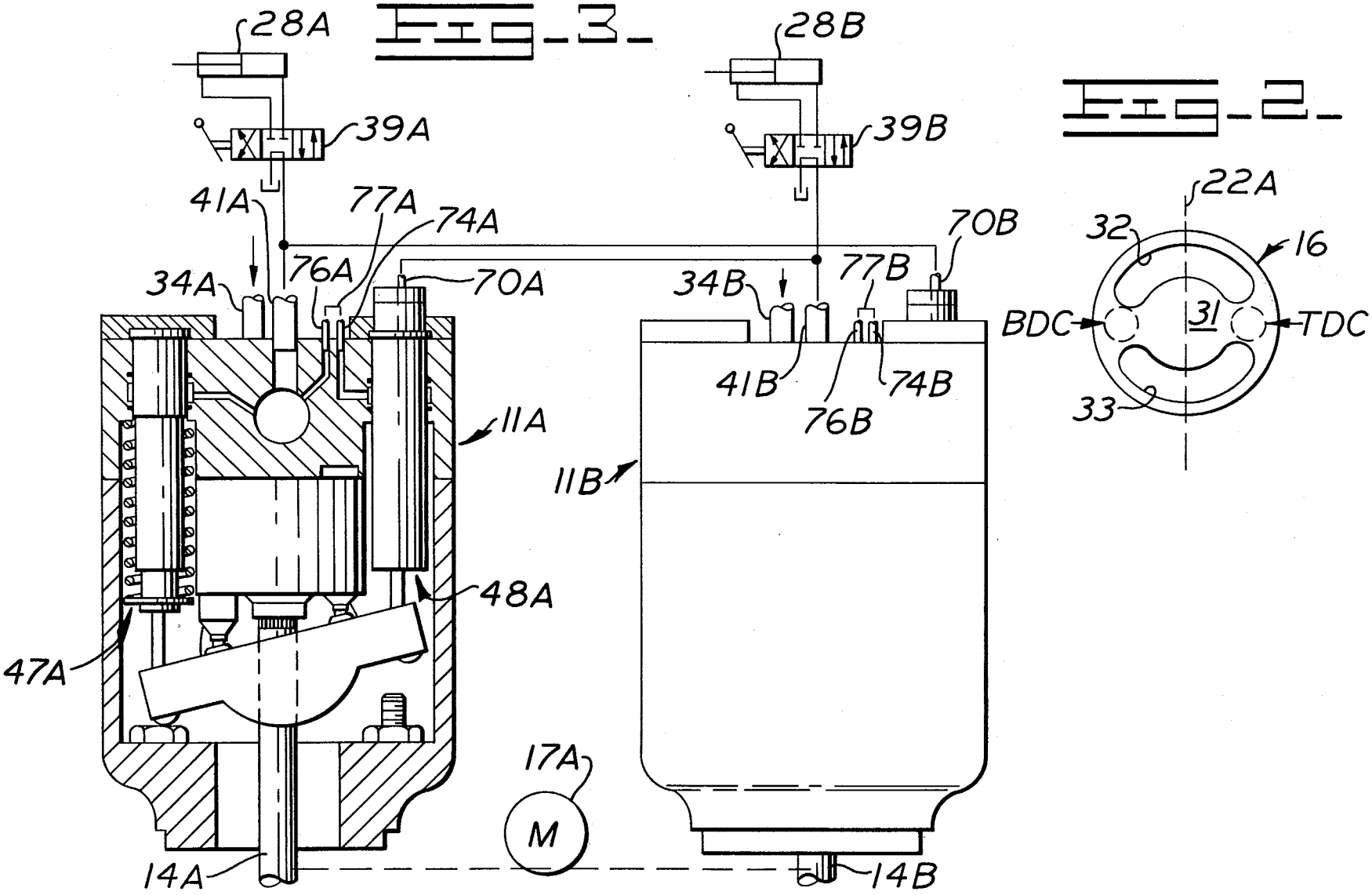
FIG. 2 is a cross-section view taken along line II—II of FIG. 1 further clarifying inlet and outlet porting of the pump of FIG. 1.
FIG. 3 is a view, partially in section and partially diagrammatic, of a pressurized fluid supply system utilizing two pumps of the type shown in FIG. 1 for operating two separate fluid-driven devices.
Figure 4:
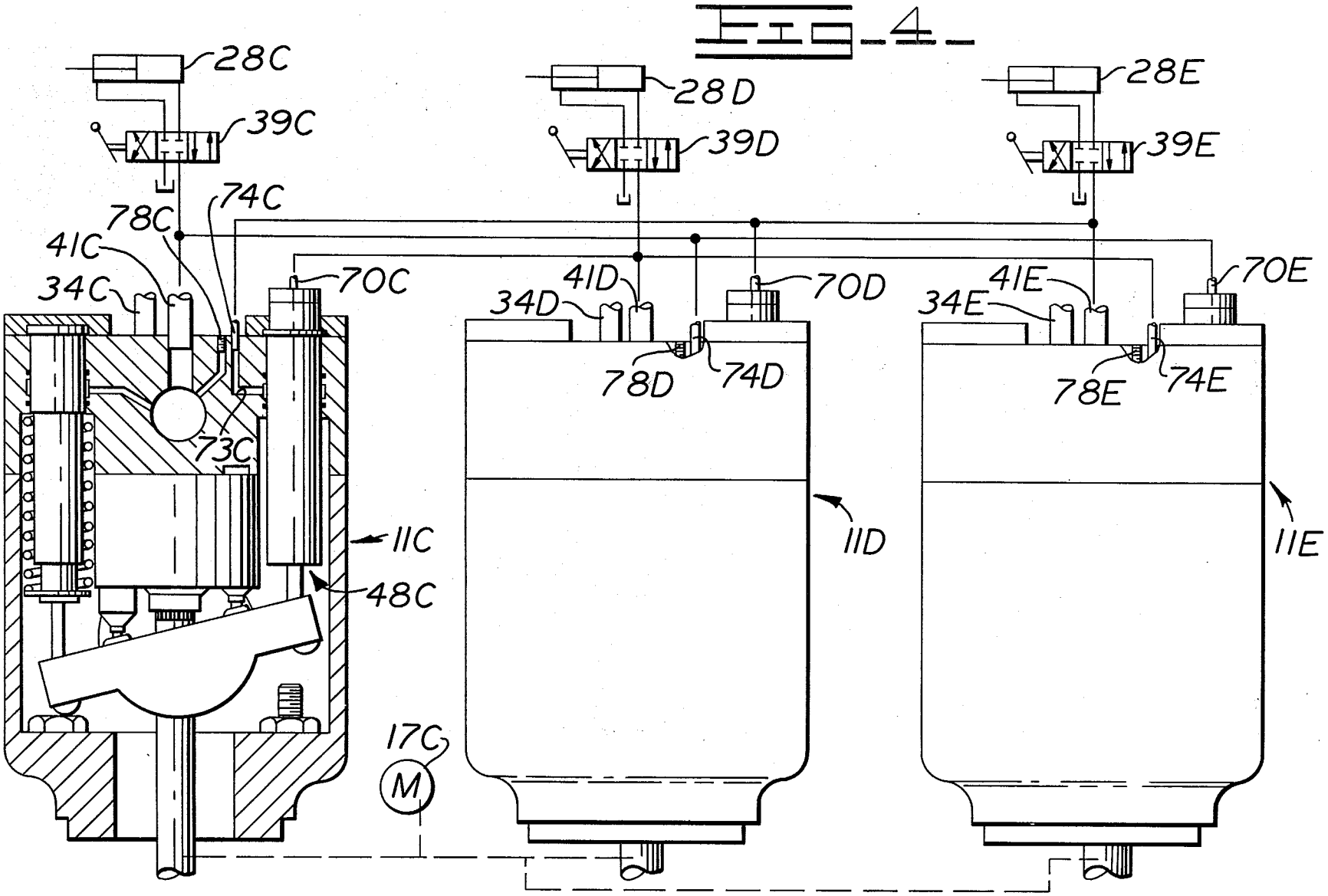
FIG. 4 is a view, partially in section and partially diagrammatic, of a pressurized fluid supply system utilizing three pumps of the form shown in FIG. 1 for operating three separate fluid-actuated devices.

Referring now to FIG. 2 in conjunction with FIG. 1, the inner face 31 of porting head 13 against which barrel 16 is abutted has a pair of semicircular grooves 32 and 33, groove 32 being an inlet groove and being communicated with a fluid inlet conduit 34 while groove 33 is an outlet groove communicated with a fluid discharge conduit 41 through a discharge passage 36 in the port plate. Inlet groove 32 is positioned, relative to the reciprocating motions of the pistons 19, to be in communication with cylinder passages 18 at a portion of the rotational motion of the cylinder passages during which the associated pistons 19 are receding away from porting head 13. Discharge groove 33 is positioned to be in communication with the cylinder passages 18 during a portion of the rotary motion of the barrel 16 at which the pistons 19 in such passages are advancing towards the porting head 13.

With the inlet conduit 34 communicated with a reservoir 37 containing hydraulic fluid or the like, rotation of the barrel 16 causes fluid to be drawn into the cylinder passages 18 through inlet groove 32 during the portion of the rotational motion at which the pistons are receding away from the porting head. During the subsequent period of barrel rotation, the pistons 19 advance towards porting head 13 and force the fluid into discharge passage 36 through outlet groove 33. Discharge passage 36 may typically be communicated with a fluid pressure-operated device 38 through a control valve 39 and discharge conduit 41.

The fluid-operated device 38 is depicted in FIG. 1 as being a fluid cylinder or actuator for purposes of example, but the pump 11 may equally well be used to supply other forms of fluid-actuated mechanism. If the device 38 is a fluid cylinder of this kind, the control valve 39 may typically be of the manually operated form having a closed position at which the head end and rod end ports of the cylinder 38 are blocked while pump discharge conduit 41 is communicated to the reservoir 37 and having two open positions at one of which the pump discharge conduit 41 is communicated to the head end of cylinder 38 while the rod end of the cylinder is communicated with the reservoir and at the other of which discharge conduit 41 communicates with the rod end of the cylinder while the head end of the cylinder is communicated to the reservoir so that the two positions respectively provide for extension and retraction of the cylinder.

While the control valve 39 of this example is of the open-centered form at which pump discharge conduit 41 is communicated with the reservoir to release pump discharge fluid at the closed position of the valve, the pump may also be used with closed-center systems at which the pump discharge conduit 41 is blocked when the control valve is in the closed position.

If limited to the structure which has been described up to this point, the axial piston pump 11 would be of essentially conventional form. In a pump of this general type, displacement is determined by the degree of angling or tilting of the swashplate 21 relative to the rotary axis of the pump as defined by the drive shaft 14. If swashplate 21 is turned about trunnion 22 so that cam surface 23 lies in a plane normal to drive shaft 14, then the pistons 19 do not reciprocate as barrel 16 is revolved and the pump displacement is zero. As the swashplate 21 is increasingly angled away from that position, pump displacement is progressively increased as the extent of reciprocatory motion of each axial piston in the course of one full revolution of barrel 16 is then progressively increased.

To define the minimum or zero displacement position, a stop 42 on one end of the swashplate 21 is positioned to contact one end of a threaded stud 43, secured to housing 12, when the swashplate is normal to the rotational axis of the pump. To define the maximum displacement position, another stop 44 at the opposite end of the swashplate 21 contacts a bolt head 46 after the swashplate has been angled away from the zero displacement position by the maximum amount. Control of the displacement of the pump is thus a matter of angularly positioning swashplate 21 about the axis of trunnion 22 within the limits defined by stops 42 and 44.

To position the swashplate 21 in an automatic manner in response to changing pressure and load conditions to be hereinafter described, a displacement-increasing biasing means 47 is disposed within pump 11 at one side of barrel 16 and porting head 13 and acts to urge the swashplate towards the maximum displacement inclination, that is, to urge the swashplate towards bolt head 46. A counterforce is exerted on the swashplate 21 by a displacement-decreasing biasing means 48 disposed within the pump at the opposite side of barrel 16 and porting head 13.

Considering first the displacement-increasing biasing means 47, a fixed spool 49 extends towards swashplate 21 from a bore 51 in the porting head 13. Spool 49 has a chamber 52 in the end facing the swashplate in which a first piston 53 is disposed for axial movement. A passage 54, partially in porting head 13 and partially in the spool 49, communicates with pump discharge passage 36 so that the piston 53 is urged in the direction of the swashplate by a fluid force which is a function of the discharge pressure of the pump. This fluid force supplements the force of a compression spring 56 disposed coaxially on spool 51 and which acts against a flange 57 at the end of piston 53. The combined fluid and spring force is transmitted to the swashplate 21 by a rockable thrust pin 58 which extends between the piston 53 and the swashplate 21. Thus, in the absence of counteracting forces, spring 56 urges the swashplate 21 to the maximum displacement position at which stop 44 abuts bolt head 46. If fluid pressure is present in the pump discharge passage 36, this force of spring 56 is supplemented by an additional fluid force, acting on piston 53, which is a function of the pump discharge pressure.

Considering now the displacement-decreasing biasing means 48, a second fixed spool 59 extends from porting head 13 towards swashplate 21 at the opposite side of barrel 16 from biasing means 47. Spool 59 has a stepped axial bore which includes a first end bore section 61 at the end closest to swashplate 21, bore section 61 being of smaller diameter than the chamber 52 of the displacement-increasing biasing means 47. An intermediate bore section 62 in spool 59 is of smaller diameter than bore section 61 while the second end section 63 of the axial bore of spool 59 is again of larger diameter and is closed at the outer end by a threaded plug 64. A second piston 66 is disposed in the first bore section 61 for axial movement therein. Forces exerted on piston 66 are transmitted to swashplate 21 by another rockable thrust pin 67 which extends between piston 66 and the end of the swashplate at which stop 42 is situated so that forces exerted on the swashplate from piston 66 oppose those exerted on the opposite end of swashplate by the piston 53 of the displacement-increasing biasing means 47.

The displacement-decreasing biasing means 48 is arranged to exert a force on the swashplate 21 which under some conditions to be described is the totalized force of two fluid pressures plus that of a compression spring 68 situated in bore section 63. To transmit the spring force and one of the fluid pressures to piston 66, an axially movable third piston 69 of smaller diameter extends through the intermediate bore section 62 and into both adjacent bore sections 61 and 63. Within bore section 63, third piston 69 is abutted by an annular flanged spring retainer 71 against which spring 68 acts while the opposite end of the intermediate piston is coupled to the piston 66 within bore section 61. During usage of the pump in a multiple-pump system, a first fluid pressure from an external source is transmitted into the bore section 63 through a fitting 70 and a first fluid-receiving passage 72 in threaded plug 64. In a single-pump system, passage 72 is a drain passage. A second fluid pressure is directed to the inner end of bore section 61, to act directly against piston 66, through a second fluid-receiving passage 73 which extends in part through spool 59 and in part through porting head 13.

In some usages of the pump which will hereinafter be described, passage 73 is communicated with the pump discharge passage 36 to transmit pump discharge pressure to bore section 61 while in other usages of the pump the passage 73 receives a fluid-pressure signal from an external source as will be described. To accommodate to either mode of operation, passage 73 may be terminated at a fitting 74 at the outer surface of porting head 13 and another adjacent fitting 76 may by communicated with the pump discharge 36. In instances where passage 73 is to receive the pump 11 discharge pressure, fittings 74 and 76 may be interconnected by a bridging conduit 77.

Spring 68 of the displacement-decreasing biasing means 48 is smaller and exerts substantially less force than the spring 56 of the displacement-increasing biasing means 47. Thus if fluid pressure is absent from all portions of the system, the pump 11 is biased to the maximum displacement position depicted in FIG. 1. In operation, fluid pressure from the discharge passage 36 supplements both of the opposed biasing means 47 and 48 but since the face area of piston 53 is greater than that of piston 66, the discharge pressure of the pump 11 does not affect the above-described condition to change the displacement of the pump insofar as such pressure acts through the biasing means 47 and 48. The mechanism does act to reduce pump displacement down to zero displacement if necessary, after discharge pressure has risen to a predetermined value, as the above-described spring forces and fluid pressures within the biasing means are supplemented by still other forces, specifically by the net swivel torque forces of the pump 11.

There are two different forms of swivel torque force which react against the swashplate 21. The first form is the inertial swivel torque force and is the smaller and less significant one. Inertial swivel torque force arises from the mass of the axial pistons 19 which undergo acceleration and deceleration in the course of the reciprocating motion in barrel 16 and generate a reaction against the swashplate 21 cam surface 23 in such a manner as to tend to force the swashplate towards the maximum displacement position. This first form of swivel torque force is a function of the weight of the pistons 19 and slipper pads 24 and of the rotational speed of the drive shaft 14 and acts essentially to supplement the force of the displacement-increasing biasing means 47. The second and more significant form of swivel torque force results from the discharge fluid pressure reacting against the axial pistons 19 and acts to supplement the force of the displacement-decreasing means 48 to an extent which is a function of discharge pressure.

The reason that the discharge pressure swivel torque force tends to urge the swashplate 21 towards the minimum displacement position may best be understood by referring to FIG. 2 of the drawing in conjunction with FIG. 1. In FIG. 2 dashed line 22A represents the rotational axis of the trunnion about which the swashplate 21 tilts. Dashed circle TDC represents the position of one of the axial pistons 19 at its top dead center position, that is, its position at the time that it has reciprocated into its closest relationship to the porting head 13. Dashed circle BCD represents the position of the piston 19 at its bottom dead center position or in other words at the time when it is most remote from the porting head 13. As may be seen in FIG. 2, the fluid inlet groove 32 and fluid outlet groove 33 of the porting head 13 are not symmetrically positioned relative to this TDC and BDC position. Outlet groove 33 in particular is located in the porting head 13 to extend closer to the top dead center position TDC than to the bottom dead center position BDC. Consequently, each piston spends less time transmitting discharge fluid pressure force to the swashplate 21 while traveling from the bottom dead center position BDC to trunnion axis 22A, at which time the force tends to shift the swashplate towards the maximum displacement position, than it does in traveling from the trunnion axis 22A to the top dead center position TDC at which time the discharge pressure force is tending to minimize displacement. The result is a net force, over repeated revolutions, in the direction which tends to minimize displacement. While a similar but opposite disparity exists while the piston is in communication with the inlet groove 32, fluid pressures acting on the pistons at that time are markedly lower or may even be negative if there is suction generated at the input and thus the effect during the motion of the piston from bottom dead center BDC to top dead center TDC greatly overrides any minor inverse effect which might be present during passage of the piston from the top dead center position back to the bottom dead center position.

Thus, with reference again to FIG. 1, a rise of pump discharge pressure due to increased loading at device 38 or other causes is accompanied by a rise of discharge pressure which then exerts two opposing effects. Insofar as such discharge pressure acts through the biasing means 47 and 48 the net effect is to increase the forces urging swashplate 21 towards the maximum displacement position. Insofar as the discharge pressure affects swivel torque forces, the effect is to increase the forces urging swashplate 21 towards the minimum displacement position. While the displacement-increasing forces are predominant at low discharge pressures, the net swivel torque effect rises more steeply as a function of discharge pressure and eventually causes the swashplate 21 to begin to shift away from the maximum displacement position. If discharge pressure continues to rise, displacement is further reduced, down to zero displacement if necessary, to limit the discharge pressure to a maximum value which is determined by the spring constants of springs 56 and 68, and the effective face areas of pistons 53 and 66 in relationship to the swivel torque force characteristics of the pump.

While the pump 11 may be utilized singly as described above, the pump construction is highly advantageous in multiple-pump systems as it enables one or more of the pumps in the system to be responsive to the discharge pressure of one or more of the other pumps in the system in such a manner as to enable operation of each pump at different power output levels and at different displacements to accommodate to varying load conditions while still providing protection against a total system overload. A first example of a multiple pump system of this form employing two pumps 11A and 11B is depicted in FIG. 3.

Referring now to FIG. 3, each of the pumps 11A and 11B of the multiple-pump system may have an internal construction similar to that described above. A single driving motor 17A is coupled to the drive shafts 14A and 14B of both motors but the two pumps independently supply fluid to separate fluid pressure-operated devices 28A and 28B through separate and independent control valves 39A and 39B respectively.

To limit the total load imposed on drive motor 17A, fitting 70A of pump 11A is communicated with the outlet conduit 41B of pump 11B while fitting 70B of pump 11B is communicated with outlet conduit 41A of pump 11A. Fittings 74A and 76A of pump 11A remain communicated through bridge conduit 77A and, similarly, fittings 74B and 76B of pump 11B remain communicated through bridge conduit 77B.

In operation, each of the pumps 11A and 11B operates substantially independently of the other provided that the loads imposed on the two pumps by the respective devices 28A and 28B are of approximately similar magnitudes and do not jointly create a power demand which might cause motor 17A to lug down or stall. Under those conditions the discharge pressure from the other pump, received at fitting 70 of each pump, has only a relatively small effect in comparison with the internal self-adjustment forces previously described.

If the discharge pressures of both pumps 11A and 11B then jointly rise by substantially similar amounts due to increased loading or other causes to the point where the power capabilities of motor 17A are about to be exceeded, the resulting rise of pressures at fittings 70A and 70B supplements the displacement-decreasing forces of both pumps in the manner previously described and the displacements of both pumps decrease in unison to the extent necessary to limit the totalized power demand on the motor 17A.

If the load on one pump increases substantially while the load on the other pump remains relatively low, a different compensating effect occurs under which the displacement of the lightly loaded pump is decreased to a greater extent than would be the case insofar as its own self-regulating actions are concerned. A greater proportion of the maximum power output of motor 17A is thereby made available to the more heavily loaded pump. In other words, instead of reducing the power delivery capacity of both pumps by equal amounts, to avoid a system overload, a greater reduction occurs at the less heavily loaded one than at the other and a more efficient usage of available power is realized.

This mode of operation may be extended to pressurized fluid supply systems having a still larger number of pumps driven by a single motor. Referring now to FIG.

4, a system is depicted in which three pumps 11C, 11D and 11E are all operated from a single drive motor 17C. Each pump 11C, 11D and 11E independently supplies pressurized fluid to a separate fluid-operated device 28C, 28D and 28E respectively through a separate and independently operable control valve 39C, 39D and 39E respectively. Interconnections between the pumps are modified to the extent that the fitting 70 of each pump is coupled to the discharge conduit 41 of a separate one of the other pumps. Thus fitting 70C of pump 11C is communicated with the discharge conduit 41D of pump 11D. Fitting 70D of pump 11D is communicated with discharge conduit 41E of pump 11E while fitting 70E of pump 11E is communicated with discharge conduit 41C of pump 11C. The displacement-decreasing biasing means 48 of each pump 11 of the embodiment of FIG. 3 does not receive the discharge pressure of that same pump through passage 73 as occurs in the previously described embodiments. Instead, the fittings 76 of the three pumps 11C, 11D and 11E are each removed and replaced by threaded plugs 78C, 78D and 78E respectively. The passage 73 of each of the pumps is then connected to the discharge flow conduit 41 of a separate one of the other pumps and more specifically to the particular one of the other pumps which does not have a discharge passage 41 already connected to fitting 70 of the same pump. Thus in the present example, fitting 74C of pump 11C is coupled to the discharge conduit 41E of pump 11E. Fitting 74D of pump 11D is coupled to the discharge conduit 41C of pump 11C and fitting 74E of pump 11E is coupled to the discharge conduit 41D of pump 11D.

As a result of the above-described interconnections, the displacement-decreasing biasing means 48 of each pump receives fluid pressure from the discharge conduits 41 of each of the other pumps of the system and these combined pressures supplement the displacement-decreasing forces internally generated in each pump. Accordingly each pump may self-adjust to operate at a different power output where load conditions dictate but the system as a whole is protected against an overall overload in a manner basically similar to that previously described with respect to the two-pump system of FIG. 3.

While the invention has been described with respect to certain exemplary embodiments, it will be apparent that numerous modifications are possible and it is not intended to limit the invention except as defined in the following claims.

The embodiments of the invention in which an exclusive property or privilege is claimed are defined as follows:

1. A pressurized fluid supply system for a plurality of fluid-operated devices comprising:

a plurality of variable displacement pumps each having a fluid inlet and a pressurized fluid discharge outlet for supplying fluid to a separate one of said devices and each having a displacement control element which may be shifted to vary the displacement thereof between a minimum value and a maximum value, each of said pumps having means for producing net swivel torque forces that urge said control element towards the minimum displacement position, each of said pumps having a displacement-increasing biasing means acting on said control element for urging said control element towards the maximum displacement position with a force which increases as fluid pressure at said discharge outlet of the pump increases and which decreases as said discharge outlet pressure decreases, and further having a displacement-decreasing biasing means acting on said control element for urging said control element towards the minimum displacement position, said displacement-increasing biasing means exerting a stronger force on said control element than said displacement-decreasing biasing means, and system output-limiting means for causing the discharge pressure of a first of said pumps to supplement the force exerted on said control element of a second of said pumps by said displacement-decreasing biasing means of said second pump to produce a greater displacement decrease at said second pump than occurs at said first pump when the discharge pressure of said first pump approaches a maximum value while the discharge pressure of said second pump is at a lower value.

2. The combination defined in claim 1 further comprising means for causing the discharge pressure of said second pump to supplement the force exerted on said control element of said first pump by said displacement-decreasing biasing means thereof to produce a greater displacement decrease at said first pump than occurs at said second pump when the discharge pressure of said second pump approaches a maximum value while the discharge pressure of said first pump is at a lower value.

3. The combination defined in claim 1 wherein said displacement-increasing biasing means of each of said pumps includes first piston means urging said control element in the direction of maximum pump displacement with a force proportional to the pressure in said discharge outlet of the pump.

4. The combination defined in claim 3 wherein said displacement-increasing biasing means of each of said pumps further includes a first spring supplementing the force exerted on said control element by said first piston means.

5. The combination defined in claim 3 wherein said displacement-decreasing biasing means of each of said pumps comprises second piston means for urging said control element in the direction of minimum displacement with a force proportional to the fluid discharge pressure from one of said plurality of pumps.

6. The combination defined in claim 5 wherein said second piston means of each of said pumps is acted on by the discharge pressure of the one of said pumps in which said second piston means is disposed.

7. The combination defined in claim 5 wherein said second piston means of each of said pumps is acted on by the discharge pressure of a different one of said pumps.

8. The combination defined in claim 5 wherein said displacement-decreasing biasing means of each of said pumps further comprises third piston means for supplementing the force of said second piston means on said control element with a force which is proportional to the fluid discharge pressure from still another of said pumps other than said one of said pumps.

9. The combination defined in claim 5 wherein said displacement-decreasing biasing means of each of said pumps further comprises a second spring supplementing the force of said second piston means on said control element.

10. The combination defined in claim 1 wherein said plurality of variable displacement pumps includes a third pump in addition to said first and second pumps and wherein said system output-limiting means includes means for causing the force exerted by said displacement-decreasing means of each pump on said control element thereof to include fluid pressure forces collectively proportional to the combined discharge fluid pressures of each of the others of the three pumps.

11. A pressurized fluid supply system for a plurality of fluid-operated devices comprising:

a plurality of variable displacement pumps each having a fluid inlet and a pressurized fluid discharge outlet for supplying fluid to a separate one of said devices and each having a displacement control element which may be shifted to vary the displacement thereof between a minimum value and a maximum value, each of said pumps being of the form which exhibit swivel torque forces that urge said control element towards the minimum displacement position, each of said pumps having a displacement-increasing biasing means acting on said control element for urging said control element towards the maximum displacement position and further having a displacement-decreasing biasing means acting on said control element for urging said control element towards the minimum displacement position, said displacement-increasing biasing means exerting a stronger force on said control element than said displacement-decreasing biasing means, said displacement-increasing biasing means of each of said pumps including first piston means urging said control element in the direction of maximum pump displacement with a force proportional to the pressure in said discharge outlet of the pump, said displacement-decreasing biasing means of each of said pumps including second piston means for urging said control element in the direction of minimum displacement with a force proportional to the fluid discharge pressure from one of said plurality of pumps, system output-limiting means for causing the discharge pressure of a first of said pumps to supplement the force exerted on said control element of a second of said pumps by said displacement-decreasing biasing means of said second pump, each of said pumps having passage means for communicating said discharge outlet thereof with said second piston means thereof, and means for selectively closing said passage means of each pump while communicating said second piston means of each pump with the discharge outlet of a different one of said pumps.

12. A pressurized fluid supply system for a plurality of fluid-operated devices comprising:

a plurality of variable displacement pumps each having a fluid inlet and a pressurized fluid discharge outlet for supplying fluid to a separate one of said devices and each having a displacement control element which may be shifted to vary the displacement thereof between a minimum value and a maximum value, each of said pumps being of the form which exhibit swivel torque forces that urge said control element towards the minimum displacement position, wherein each of said pumps is an axial piston pump having a housing and a rotatable barrel therein with said barrel having at least one cylinder passage extending parallel to the axis of rotation of the barrel and which has at least one axial piston disposed in said cylinder passage for reciprocation therein and wherein said control element of each pump is a swashplate which may be adjustably tilted relative to said axis of rotation to vary the stroke length of said axial piston in said barrel, each of said pumps having a displacement-increasing biasing means acting on said control element for urging said control element towards the maximum displacement position wherein said displacement-increasing biasing means of each pump includes a first spring positioned to exert a force on one end of said swashplate in a direction tending to increase the degree of tilt of said swashplate relative to said rotary axis and first piston means for supplementing the force of said first spring with a force proportional to the pressure at said discharge outlet of the pump in which said first piston means is situated, each of said pumps further having a displacement-decreasing biasing means acting on said control element for urging said control element towards the minimum displacement position, said displacement-increasing biasing means exerting a stronger force on said control element than said displacement-decreasing biasing means, said displacement-decreasing biasing means of each pump including means forming a bore having a first end section and an intermediate section and a second end section, a second piston disposed in said first end section of said bore and a third piston disposed in said second end section of said bore, second spring means disposed in said second end section of said bore and acting to urge said third piston towards said second piston, means for transmitting force from said second piston to said swashplate to urge said swashplate toward said minimum displacement position thereof, and first fluid pressure-receiving means communicated with said second end section of said bore for introducing a fluid pressure to supplement the force of said second spring on said third piston, and second fluid pressure-receiving means communicated with said first end section of said bore for introducing another fluid pressure to supplement the force exerted by said second piston on said swashplate, and system output-limiting means for causing the discharge pressure of a first of said pumps to supplement the force exerted on said control element of a second of said pumps by said displacement-decreasing biasing means of said second pump.

* * * * *